United States Patent [19]

Drews

[11] Patent Number: 4,915,032

[45] Date of Patent: Apr. 10, 1990

[54] DOOR HANGER ASSEMBLY

[76] Inventor: Walter Drews, 422 Field St., Naugatuck, Conn. 06770

[21] Appl. No.: 330,412

[22] Filed: Mar. 29, 1989

[51] Int. Cl.[4] ..... B16D 1/00; E05D 15/00

[52] U.S. Cl. ..... 105/329.1; 16/87 R; 16/87.6 R; 16/96 R; 16/98; 16/102; 105/333; 105/339

[58] Field of Search ..... 105/329.1, 343, 333, 105/339, 370, 225, 379; 16/87 R, 87.6 W, 87.6 R, 89, 87.4 R, 87.4 W, 91, 94, 96 R, 95 R, 104, 106, 98, 102; 160/49

[56] References Cited

U.S. PATENT DOCUMENTS 922,241 5/1909 Bartholomae ..... 16/89

FOREIGN PATENT DOCUMENTS 1136207 5/1957 France ..... 16/87 R

*Primary Examiner*—Andres Kashnikow
*Assistant Examiner*—Matthew C. Graham
*Attorney, Agent, or Firm*—McCormick, Paulding & Huber

[57] ABSTRACT

A door hanger assembly for a rapid transit railway passenger car includes an axially elongated generally cylindrical support shaft, and a door carrier assembly which includes a pair of bearing modules received and supported within opposite ends of a tubular sheath for rolling engagement with the support shaft and a door hanger depending from the sheath. Mounting members connected to opposite ends of the support shaft carry threaded fasteners for securing the hanger assemby to the frame of an associated rail car. Annular wipers and lubricant retainers carried by the bearing modules wipe and lubricate the support shaft as an associated sliding door carried by the hanger assembly moves between its open and closed positions.

11 Claims, 1 Drawing Sheet

DOOR HANGER ASSEMBLY

BACKGROUND OF THE INVENTION

This invention relates in general to door hanger assemblies and deals more particularly with an improved hanger assembly for a vertically hung, power operated sliding door for a rapid transit railway passenger car or the like and which may be of either straight or vertically contoured type. Such doors are subjected to heavy usage, abuse, vandalism and hostile environments. Dirt, metallic particles produced by car braking, and other atmospheric contaminants encountered in subway tunnels, for example, which accumulates on exposed bearing surfaces causes undue war and adversely affects door operation.

A vertically hung contoured door presents difficult installation and adjustment problems, because the center of gravity of such a door is usually not located in vertical alignment with the hanger assembly which supports it. Adjustment problems are also encountered with bi-parting doors having co-engaging edge seals which must seal properly to maintain the integrity of car climate control systems.

A typical rapid transit railway passenger car may have as many as eighteen individually hung doors. Failure of any rail car door to function properly usually requires that the door be locked in closed position until the car can be removed from service for maintenance or repair, which poses an obvious safety hazard and may disrupt normal scheduling.

The general aim of the present invention is to provide an improved hanger assembly for a door of the aforedescribed type and which is durable, reliable, simple to install and adjust, and overcomes the various problems hereinbefore discussed.

SUMMARY OF THE INVENTION

In accordance with the present invention, an improved door hanger assembly comprises an axially elongated generally cylindrical support member and a pair of bearing modules supported in rolling engagement with and coaxially surrounding associated portions of the support member. The hanger assembly further includes a tubular bearing sheath containing the bearing modules, receiving the support member therethrough and maintaining the modules in axially spaced apart relation to each other. At least one door hanger depends from the tubular sheath. Means are provided for securing the support member to the frame of an associated railway car in a generally axially horizontally oriented position.

DETAILED DESCRIPTION OF PREFERRED EMBODIMENT

Figure 1:
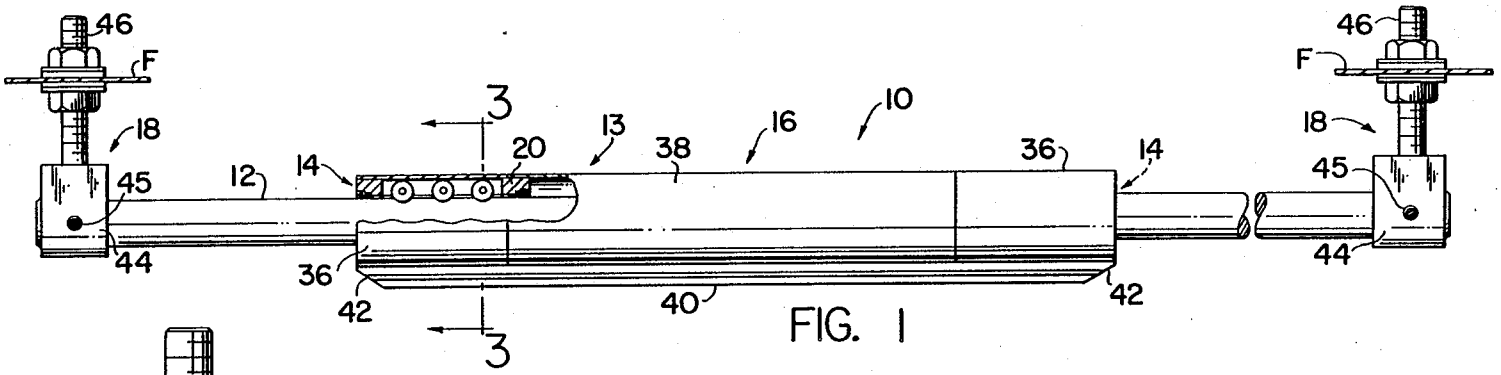
FIG. 1 is a fragmentary side elevational view of a door hanger assembly embodying the present invention shown partially in axial section and mounted on the frame of an associated railway car.

Turning now to the drawing, a door hanger assembly for a rapid transit railway passenger car and embodying the present invention is indicated generally by the reference numeral 10. The illustrated hanger assembly 10, shown in FIG. 1 mounted on a car frame F, may be used to hang doors of either straight or vertically contoured type. However, in FIG. 2 a typical straight door D is shown connected to the hanger assembly.

The illustrated assembly 10 essentially comprises an axially elongated cylindrical support member or shaft 12 and a door carrier assembly, designated generally by the numeral 13, which includes a pair of bearing modules indicated generally at 14,14 (one shown). The bearing modules are supported in rolling engagement with the support member 12 and are contained within opposite ends of a tubular sheath, indicated generally at 16, which carries a door hanger 40. A pair of mounting members, designated generally by the numerals 18,18, secure the hanger assembly 10 in properly adjusted position to an associated car frame, such as the frame F, all of which will be hereinafter fully discussed.

Considering the hanger assembly 10 in further detail, the support member 12 preferably comprises a hardened cylindrical steel rod or shaft of suitable length to allow required door travel therealong. The bearing modules 14,14 are substantially identical and each includes a generally cylindrical body member 20 which has a coaxial cylindrical bore 22 extending through it. The bore 22 has a diameter slightly larger than the diameter of the shaft 12. Preferably, and as shown, a pair of outwardly open stepped annular recesses 24,24 are formed in the body 20 at opposite ends of the bore 22 for a purpose to be hereinafter explained. A plurality of angularly spaced apart radially disposed and axially extending slots 26,26 formed in the body 20 open into the bore 22. The number and arrangement of the slots may vary, but in the illustrated embodiment of the invention, three slots 26,26 are provided and arranged in equiangularly spaced relation to each other about the axis of the bore 22, as best shown in FIG. 3.

Figure 3:
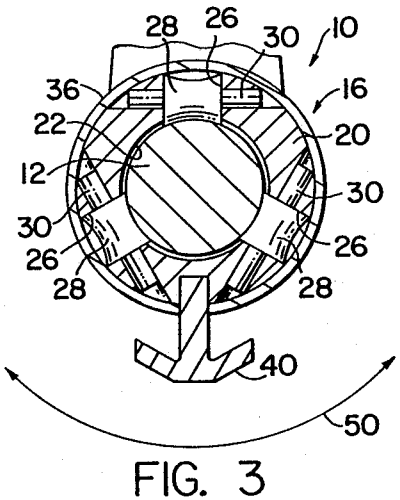
FIG. 3 is a fragmentary sectional view taken along the line 3—3 of FIG. 1.

At least one roller bearing 28 is supported within each slot 26 by an associated axle 30 having end portions received in apertures in the body 20, substantially as shown in FIG. 3. Preferably, each bearing 28 is supported by an associated axle for rotation about an axis disposed in a radial plane and normal to an axial plane of the bore 22. The number of roller bearings provided in each module may vary and will generally be determined by the load requirements imposed by an associated door to be carried by the hanger assembly 10. However, the illustrated bearing module 14 has three roller bearings 28,28 supported in each slot 26. Preferably, and as shown, each roller bearing 28 has an annular peripheral groove of arcuate cross-sectional configuration which substantially complements an associated portion of the shaft 12 along which it travels.

Figure 4:
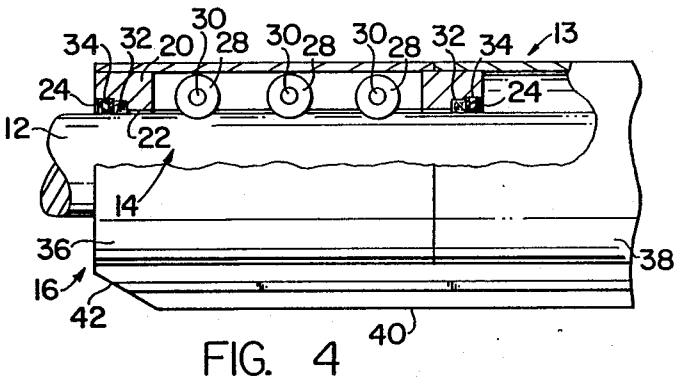
FIG. 4 is a somewhat further enlarged fragmentary view of the door hanger assembly as it appears in FIG. 1.

At least one annular lubricant retainer 32, best shown in FIG. 4, which may, for example, comprise a felt washer saturated with an appropriate lubricant, is carried by each bearing module 14. Preferably, and as shown, each bearing module 14 has two such lubricant retainers 32,32, each retainer being received within an associated annular recess 24 and retained therein by a suitable annular spring locking member. Each bearing module 14 also carries at least one annular shaft wiper 34, best shown in FIG. 4. The wiper is preferably made from elastomeric material to engage and wipe the rail 12 and is retained within an associated recess 24 by an appropriate annular spring locking member of the type well-known in the art. However, in accordance with the presently preferred construction, each bearing module 14 carries two such shaft wipers 34,34.

The tubular sheath 16 may comprise a single axial elongated tubular member sized to receive the bearing modules 14,14 in the opposite ends thereof. However, in accordance with the presently preferred construction, the tubular sheath 16 is formed by three contiguous sections of generally cylindrical metal tubing indicated respectively at 36,36 and 38. The end sections 36,36 are of slightly shorter axial length than the bearing modules 14,14 and are received on the bearing modules, substantially as shown in FIG. 1. The center section 38 receives an inner end portion of each bearing module 14, as shown in FIG. 1, and serves as a spacer to maintain the two bearing modules 14,14 in axially spaced apart relation to each other.

Each sheath section 36 may be press fitted on or otherwise suitably secured to an associated module body 20. The length of the central portion 38 may vary in accordance with support requirements imposed by doors of differing size.

Figure 2:
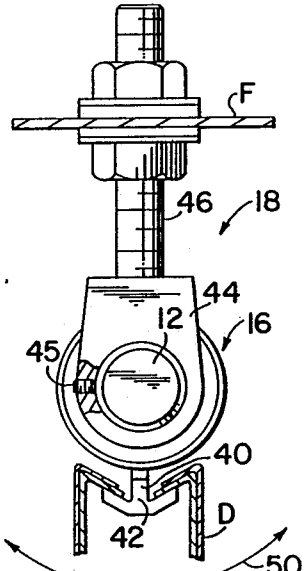
FIG. 2 is a somewhat enlarged fragmentary end elevational view of the hanger assembly shown assembled with an associated railway car door.

At least one door hanger 40 is welded or otherwise suitably secured in depending relation to the bodies of the bearing modules or to the tubular sheath 16, substantially as shown. The illustrated hanger 40 has an inverted T-shape cross-section as shown in FIGS. 2 and 3, however, hangers of other types may be employed, as necessary, to accommodate doors of other types. The illustrated hanger 40 extends along the entire length of the tubular sheath 16 and has upwardly and outwardly inclined end surfaces 42,42 which cooperate with wedges (not shown) used to secure an associated door, such as the door D to the hanger 40.

Each mounting member 18 includes a mounting clevis 44 having a bore for receiving an associated end portion of the shaft 12. Each mounting clevis 44 is secured to the shaft 12 by a clamping screw 45 and carries an associated threaded fastener 46 which projects from the clevis in radial relation to the axis of the shaft 12. Self-aligning spherical nut and washer assemblies of a type well-known in the art are preferably used to secure the hanger assembly 10 to the frame of an associated rail car, such as the frame F shown in FIG. 1.

The fasteners 46,46 which secure the hanger assembly 10 to an associated car frame, such as the frame F, permit vertical adjustment so that the assembly 10 may be secured with the axis of the shaft 12 in a horizontal or near horizontal position, as may be required for proper operation of an associated door. The car frame is usually constructed so that the fasteners 46,46 will be in substantially parallel alignment with each other. However, if the car frame is damaged so that parallel alignment of the fasteners 46,46 is not easily attained, the mounting clevises 44,44, which may be angularly adjusted about the axis of the shaft 12 and relative to each other, permit compensation for such slight misalignment. Specifically, the adjustable clevises 44,44 may be clamped to the shaft 12 after the fasteners 46,46 have been secured to the car frame. It should also be apparent that the manner in which the bearing modules engage the cylindrical shaft allow for substantial self-alignment of an associated door, such as the door D shown connected to the hanger assembly 10 in FIG. 2. This rotary self-alignment feature, indicated by the directional arrow 50 in FIGS. 2 and 3, makes the hanger assembly 10 particularly suitable for either straight or curved door applications.

Since the roller bearings 28,28 are sealed within the tubular sheath 16, the roller surfaces are protected from direct contamination. Each time the associated door moves between its open and closed position, the annular shaft wipers 34,34 at opposite ends of the bearing modules 14,14 wipe the shaft 12 to keep it free of dirt and other contaminants while the lubricant retainers 32,32 apply a thin film of lubricant to the shaft. The hardened steel shaft 12 is not likely to develop appreciable wear during the normal life of the hanger assembly 10. However, should such wear occur, it may easily be eliminated by loosening the clamping screws on the mounting clevises 44,44, which support the opposite ends of the shaft 12, and rotating the shaft through a small angle about its axis to provide new shaft bearing surfaces for the roller bearings 28,28, and reclamping the shaft in its newly attained position.

I claim:

1. A door hanger assembly for a railway passenger car and comprising an axially elongated cylindrical support member, a pair of bearing modules, each of said bearing modules having a body and including a bore receiving said support member therethrough and a plurality of roller bearings mounted on said body and disposed in rolling engagement with said support member, an axially elongated tubular sheath received on said support member, each of said bearing modules being disposed within an associated end portion and said tubular sheath, said bearing modules being maintained in axially spaced apart relation to each other by said sheath, at least one door hanger depending from said sheath, and means for adjustably securing said support member in fixed position relative to the frame of an associated railway car such as aforesaid with the axis of said shaft generally horizontally disposed.

2. A door hanger assembly as set forth in claim 1 including at least two annular wipers surrounding said support member in coaxial wiping engagement with the surface thereof, one of said wipers being carried by one of said bearing modules and another of said wipers being carried by the other of said bearing modules.

3. A door hanger assembly as set forth in claim 2 wherein each bore has a diametrically enlarged end portion and each of said wipers is received and retained within an associated bore end portion.

4. A door hanger assembly as set forth in claim 1 including at least two annular lubricant retainers coaxially surrounding said support member in engagement with the surface thereof, one of said lubricant retainers being carried by one of said bearing modules and another of said lubricant retainers being carried by the other of said bearing modules.

5. A door hanger assembly as set forth in claim 4 wherein each bore has a diametrically enlarged end portion and each of said lubricant retainers is received and retained within an associated bore end portion.

6. A door hanger assembly as set forth in claim 1 wherein said tubular sheath is formed by three contiguous sections including a center section and two end sections and said bearing modules are received in said end sections.

7. A door hanger assembly as set forth in claim 6 wherein said end sections are of somewhat shorter axial length than said bearing modules contained therein and the inner ends of said bearing modules are received in the end portions of said center section.

8. A door hanger assembly comprising an axially elongated generally cylindrical support member, a door carrier assembly coaxially surrounding an associated portion of said support member and supported for reciprocal axial movement in rolling engagement with said support member and including an axially elongated generally cylindrical tubular sheath receiving said support member therethrough, a pair of bearing modules, each of said modules being received in an associated end portion of said sheath, and a door carrier mounted on said sheath, and means for supporting the opposite ends of said support member in fixed position relative to the frame of an associated railway car for radial and angular adjustment relative to the frame.

9. A door hanger assembly for a railway car comprising an axially elongated generally cylindrical shaft, a door carrier assembly supported in rolling engagement with said shaft and including an axially elongated generally cylindrical tubular sheath coaxially surrounding an associated portion of said shaft, a pair of bearing modules, each of said modules received and retained within an associated end portion of said tubular sheath and including a generally cylindrical body having an outside diameter substantially equal to the inside diameter of said tubular sheath, said body having a coaxial bore receiving said shaft therethrough and including diametrically enlarged end portions opening through the ends of said body and communicating with said bore, said body having at least three equiangularly spaced and axially extending slots therein communicating with said bore, a plurality of roller bearings disposed in each of said slots, each of said roller bearings being carried by an associated axle mounted in said body and journalled for rotation about an axis disposed within a radial plane of said body and normal to an axial plane of said body, each of said roller bearings being disposed in rolling engagement with said shaft and including a circumferential groove having a cross-sectional configuration substantially complementing the cross-section of an associated portion of said shaft, a pair of annular lubricant retainers, each of said lubricant retainers being disposed within an associated one of said diametrically enlarged end portions and in coaxial surrounding engagement with said shaft, a pair of annular elastomeric shaft wipers, each of said shaft wipers being received and retained within an associated one of said diametrically enlarged end portions and coaxially surrounding said shaft in wiping engagement therewith, and means for adjustably securing said hanger assembly to the frame of an associated railway car and including a pair of clevises, each of said clevises being received on an associated end portion of said shaft, and a pair of threaded fasteners, each of said fasteners projecting from an associated one of said clevises and in a generally radial direction relative to the axis of said shaft, and means for releasably securing said clevises in fixed angular positions relative to said shaft.

10. A door hanger assembly as set forth in claim 9 wherein said sheath has three contiguous sections including a center section and a pair of end sections and each of said bearing modules is received in an associated one of said end sections.

11. A door hanger assembly as set forth in claim 10 wherein said end sections are of slightly shorter length than said bearing modules and a portion of the inner end of each body is received in an associated end portion of said center section.

* * * * *